US006258242B1

(12) United States Patent
Marchandise et al.

(10) Patent No.: US 6,258,242 B1
(45) Date of Patent: Jul. 10, 2001

(54) PROCESS FOR SURFACE PREPARATION AND POLYANILINE DEPOSITION FOR THE ABSORPTION OF LIGHT

(75) Inventors: Didier Marchandise, Reins; Robert Marrugat, Courberaie, both of (FR)

(73) Assignee: Aerospatiale Matra, Paris (FR)

( * ) Notice: Subject to any disclaimer, the term of this patent is extended or adjusted under 35 U.S.C. 154(b) by 0 days.

(21) Appl. No.: 09/500,015

(22) Filed: Feb. 8, 2000

(30) Foreign Application Priority Data

Feb. 8, 1999 (FR) ..... 99 01440

(51) Int. Cl.[7] ..... C23C 28/00; C25D 5/34; C25D 5/50; C25D 5/48

(52) U.S. Cl. ..... 205/188; 205/210; 205/224; 205/229; 205/208

(58) Field of Search ..... 205/188, 210, 205/224, 229, 208

(56) References Cited

U.S. PATENT DOCUMENTS

| | | | |
|---|---|---|---|
| 4,111,762 | 9/1978 | Wade et al. | 204/33 |
| 4,233,107 | 11/1980 | Johnson, Sr. | 156/632 |
| 4,361,630 | 11/1982 | Johnson, Sr. | 428/613 |
| 4,589,972 | 5/1986 | Pompea et al. | 204/29 |
| 5,294,694 | 3/1994 | Epstein et al. | 528/210 |

OTHER PUBLICATIONS

Mazella et al., "Electrodeposition of an Adhesive Promoter on Titanium Alloy TA6V. Effect of Substrate Surface Treatment", Vide, Couches Minces, vol. 251 (Suppl.). pp. 75–77, 1990.*

Geskin, "Electrodeposition of Polyaniline onto Non–noble Metals", J. Chim. Phys.—Chim. Biol. , vol. 89, No. 5, pp. 1215–1220, 1992.*

*No month available.*

*Abstract only.*

* cited by examiner

*Primary Examiner*—Edna Wong

(74) *Attorney, Agent, or Firm*—Burns Doane Swecker & Mathis LLP

(57) ABSTRACT

The invention relates to a process for the deposition of light-absorbing polyaniline, particularly on a titanium substrate, the process comprising:

a fluoronitric etching, a chemical conversion treatment, a hydrolysis and a deposition of polyaniline by electropolymerization.

9 Claims, 4 Drawing Sheets

PROCESS FOR SURFACE PREPARATION AND POLYANILINE DEPOSITION FOR THE ABSORPTION OF LIGHT

DESCRIPTION

1. Field of the Invention

The invention is in the field of devices having a radiation-absorbing coating, particularly a coating of polyaniline absorbing radiation in a band extending from the ultraviolet to the infrared. It also relates to a process for the preparation of surfaces receiving the deposit.

2. Prior Art

A wide range of surface treatments or surface coatings only having a limited specular reflection and only a limited diffuse reflection is known. These treatments or coatings are sought, particularly for optical or infrared applications. They contribute to mechanical elements such as input optics supports of optical devices not reflecting or only reflecting a little light and thus not increasing the signal to noise ratio of the optical or infrared signal intercepted by the detectors of such devices.

Problems known in connection with such coatings and which it is wished to solve by improvements to surface treatment and/or coating deposition processes are e.g. described in column 1 of U.S. Pat. No. 4,589,972 of May 20, 1986, granted to Martin Marietta. The problems referred to in this patent and which it is wished to solve according to the present invention are given hereinafter.

With regards to black paints, it is known that they have a tendency to crack or be detached from in particular metal substrates, due to stresses induced by thermal cycles, particularly for infrared systems operating with sensors cooled to the temperature of helium or liquid nitrogen.

These phenomena become worse with the thickness of the paint coating, said thickness generally increasing with the wavelength of the radiation which it is wished to absorb.

Another problem encountered is due to the degassing of the coating, particularly when the coated material operates at high altitudes or in space. The products resulting from the degassing can chemically react and damage microelectronic components or condense on cooled optical surfaces so as to obscure them.

The Martin Marietta U.S. Pat. No. 4,589,972 proposes, like an earlier U.S. Pat. No. 4,111,762, of Martin Marietta to which U.S. Pat. No. 4,589,972 refers, improving the solution to these problems in two ways. These two improvements are applicable to previously anodized, anodizable metals, particularly aluminium and beryllium.

The process provides for a treatment of the surface by an aluminium oxide jet with a grain size of 100 to 200 mesh. This initial treatment aims at creating a roughness of the surface prior to anodization.

It is indicated at the top of column 7 of said patent, that the increased roughness of the treated surface has a significant effect on the absorption and reflectivity of the surface. The specular reflection is reduced and the dispersion of the incident radiation due to the relief created increases absorption.

The importance of the roughness state of the surface has been recognized by most experts. Reference is also made in this connection to the Johnson U.S. Pat. Nos. 4,233,107 and 4,361,630, the latter being a continuation of the former. In the process described in said patent a substrate is firstly treated by means of a plating of a phosphorous nickel alloy. The thus coated surface is then made rough by means of a bath in a nitric acid aqueous solution which brings about an acid etching of the deposited plating. This leads to a very good absorption in the range 320 to 2140 nanometres.

Thus, it is generally known in the art that a roughening treatment of the surface to be treated before (Marietta patent) or after (Johnson patent) coating or other surface treatment is likely to improve the absorption qualities. However, for each wavelength range to be absorbed and for each treatment and also as a function of the substrate, it is necessary to adapt the roughening treatment.

In a first aspect the present invention is directed at such a roughening treatment.

Under another aspect it is directed at a process for depositing a polyaniline absorbing coating, said deposition preferably taking place after the surface has been roughened prior to the polyaniline coating application operations.

The use of polyaniline for absorbing electromagnetic radiation is in itself known. In this connection reference is made to the patents of EPSTEIN et al U.S. Pat. No. 5,079,334 and various continuations thereof U.S. Pat. Nos. 5,147,968, 5,294,694 and 5,563,182. In these various patents EPSTEIN explains the reasons for the absorbing qualities of polyaniline and the possible applications. U.S. Pat. No. 5,294,694 claims a method for the absorption of electromagnetic waves by means of a polyaniline composition. This patent expressly envisages the ultraviolet to the infrared range.

This patent only very briefly mentions the treatments to be applied to the surfaces to be coated and the deposition method. Thus, it is stated in column 7, lines 55 to 63 of said patents that aniline can be applied by virtually any known method. Among these methods, it refers to electrochemical deposition on conductive substrates. Column 8, lines 5 to 20 also refers to the deposition of films.

The applicant has carried out experiments in which a polyaniline was used as the absorbing coating. It was found that polyaniline had good absorbing qualities, but the total reflection value remains high in the infrared. There is not a good adhesion to the substrate and there is a definite coating foliation tendency.

These experiments revealed that there is a need for a deposit of a polyaniline coating absorbing electromagnetic radiation in the ultraviolet to infrared ranges, which adheres well to the substrate and has no reflection peak in the infrared range.

BRIEF DESCRIPTION OF THE INVENTION

Therefore the invention relates to a process for the preparation of the surface of a substrate for receiving a polyaniline coating, able to absorb in the ultraviolet to infrared range, characterized in that the surface of the substrate is roughened prior to the performance of the polyaniline coating deposition stages.

It has been found that the best results from the absorption standpoint were obtained when the roughness value of the substrate surface is between 10 and 30 $\mu$m. This is the mean square value of the variations between the topmost points of the surface and the bottommost points of the slow undulations of the surface known under the name of roughness Ra. With this initial roughness of the substrate there is a good diffusion effect, particularly in the range 0.25 to 16 $\mu$m. In addition, this diffusion aids absorption.

This Ra value can e.g. be obtained on a titanium substrate by sandblasting with an abrasive. This operation can be carried out with corundum with a grain size between 30 and 120 mesh.

In an embodiment, sandblasting was carried out with such a corundum under a pressure of 6 bars at a distance from the surface to be treated of approximately 20 cm. A double passage was effected with a coverage level of 100%.

This initial substrate preparation phase is necessary for reducing or eliminating the specular reflection peak in the infrared. Aniline deposition, according to a second aspect of the invention, can be carried out after this preparatory phase relative to the obtaining of the roughness of the substrate surface. It may also not be carried out if the specular reflection or absorption value obtained without this prior roughening treatment are considered to be adequate.

According to this second aspect, the invention relates to a process for depositing a polyaniline coating on a titanium or titanium alloy substrate, characterized in that the operating range of deposition successively comprises:

a fluoronitric etching, a chemical conversion treatment, a hydrolysis and a polyaniline deposition by electropolymerization.

If the substrate is not perfectly clean, it is appropriate to carry out a prior cleaning stage (alkaline, solvent or mechanical cleaning).

An example of the production of a polyaniline coating on a substrate and a brief description of the optical results obtained will now be given in connection with the attached drawings.

BRIEF DESCRIPTION OF THE DRAWINGS

FIG. 1, consisting of FIGS. 1*a,* 1*b,* 1*c,* shows scanning electron microscope views of a TA6V alloy surface coated with a polyaniline deposit under an inclination of 30°:

FIG. 2 comprises FIGS. 2*a,* 2*b* and 2*c* showing scanning electron microscope views of a TA6V alloy surface coated with a polyaniline deposit, the surface having been previously roughened by sandblasting (inclination 30°):

FIG. 3 is a curve for polyaniline deposited according to the process of the invention without prior sandblasting.

FIG. 4 shows a curve for polyaniline deposited with prior sandblasting.

Figure 1A:
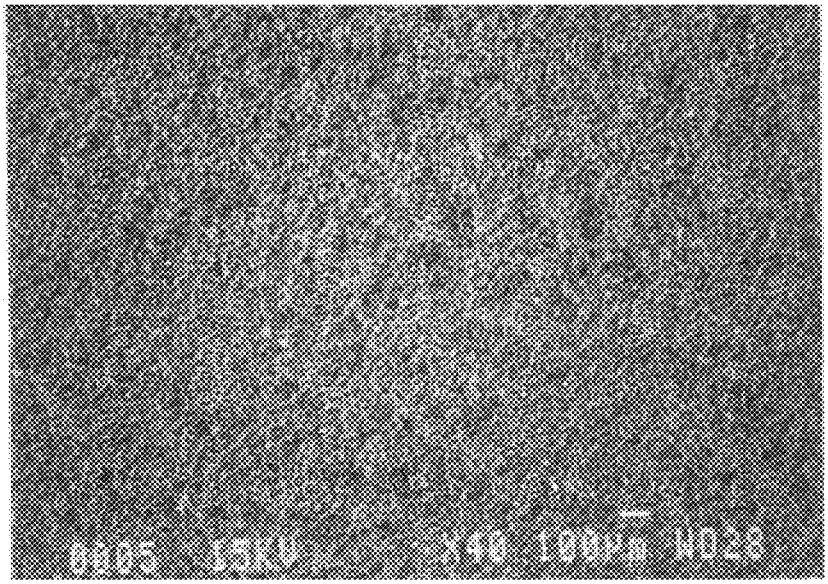
FIG. 1*a* with a magnification of 40.

Polyaniline deposition takes place on TA6V titanium alloys. The different stages of the operating range are as follows:

| ALKALINE CLEANING | |
|---|---|
| Sodium tripolyphosphate | $Na_5P_3O_{10}$:40 g/l |
| Sodium tetraborate | $Na_2B_4O_7$, 10 $H_2O$:40 g/l |
| Surfactant | Ref. 631:10 ml/l |
| Soda | NaOH:pH = 9 |
| Operating temperature | 60° C. |
| Duration | 10 minutes |

-continued

| FLUORONITRIC ETCHING | |
|---|---|
| Nitric acid 41° Bé | $HNO_3$:141 ml |
| Hydrofluoric acid (48%) | HF:50 ml |
| Additive | F 68:1 g |
| TA6V (metal) | 1.5 g |
| Distilled water | ad:11 |
| Operating temperature | 20° C. |
| Duration | 2 min 15 s |
| CHEMICAL CONVERSION BATHS | |
| Sodium difluoride | NaFHF:13 g/l |
| Operating temperature | 20° C. |
| Duration | 1 min 45 s |
| HYDROLYSIS | |
| Demineralized water | |
| Operating temperature | 90° C. |
| Duration | 15 minutes |
| ELECTROPOLYMERIZATION | |
| Liquid aniline | 0.1 mole/liter |
| Sodium sulphate | $Na_2SO_4$, 10 $H_2O$:0.5M |
| Sulphuric acid | $H_2SO_4$ ad pH = 1 |

The durations, product concentrations and the natures of the products used and given hereinbefore, can naturally be modified in per se known manner to obtain the same results. The inventors did not investigate all the usable product ranges and times necessary for the treatments, but consider a priori for alkaline cleaning with the same products, the proportions or durations given hereinafter could be used.

| ALKALINE CLEANING | |
|---|---|
| Sodium tripolyphosphate | $Na_5P_3O_{10}$:36 to 44 g/l |
| Sodium tetraborate | $Na_2B_4O_7$, 10 $H_2O$:40 g/l |
| Surfactant | REf. 631:10 ml/l |
| Soda | NaOH:pH = 8.5 to 9.5 |
| Operating temperature | 55 to 65° C. |
| Duration | 10 to 15 minutes |

With regards to fluoronitric etching, the acid proportions could be increased and the bath time decreased, or both could be decreased, the bath time remaining equivalent, but the bath temperature being increased. The durations and proportions could be as follows:

| FLUORONITRIC ETCHING | |
|---|---|
| Nitric acid 41° Bé | $HNO_3$:100 to 180 ml |
| Hydrofluoric acid (48%) | HF:40 to 60 ml |
| Additive | F 68:1 g |
| TA6V (metal) | 1.5 g |
| Distilled water | ad:11 |
| Operating temperature | 18 to 22° C. |
| Duration | 2 to 2.5. |

In the electropolymerization bath, the part to be treated, testpieces being used in the laboratory, is the working electrode of a cell having three electrodes (stainless counterelectrode and saturated calomel reference electrode (ECS)). The alloy is polarized to −0.5 V/ECS for 3 min and then undergoes anodic scanning at a speed of 10 mV/s until the imposed voltage reaches +2 V/ECS. The scan is then stopped, but the polarization is maintained for 20 minutes.

The indicated voltages are measured between the calomel reference electrode and the working electrode.

After electropolymerization, the testpieces can be stored at a temperature between 40 and 160° C. for between 30 min and 2 hours, e.g. 1 hour at 160° C.

Each stage of the preparation range is important and polyaniline polymerization tests were carried out after each of these stages. It was found that:

after a fluoronitric etching, the electropolymerized polyaniline does not adhere to the titanium alloy surface, the chemical conversion treatment aids the adhesion of the polyaniline, but the coating distribution is heterogeneous, the hydrolysis treatment is indispensable for producing an adhering, homogeneous film.

The NaFHF conversion treatment leaves on the surface of the alloy a small amount of fluorine, which the hydrolysis treatment is able to reduce, but not completely eliminate. This hydrolysis treatment would appear to aid the polyaniline deposit formation speed. The induction time is shorter and the quantity deposited at the end of a given maintenance time is greater.

In order to simplify the operating range, complimentary electropolymerization tests were carried out on TA6V testpieces which were previously anodized in a sulphuric medium. It was not possible to produce an adhering polymer film.

Optical characterization tests of the treated testpieces revealed good absorption characteristics and a low specular reflection. However, there remained a specular peak for wavelengths of 10.6 $\mu$m.

In order to eliminate this peak, the roughness of the surface of the titanium alloy was modified by sandblasting. This sandblasting carried out prior to the polyaniline deposition stages leads to a surface roughness Ra between 10 and 30 $\mu$m.

Figure 1B:
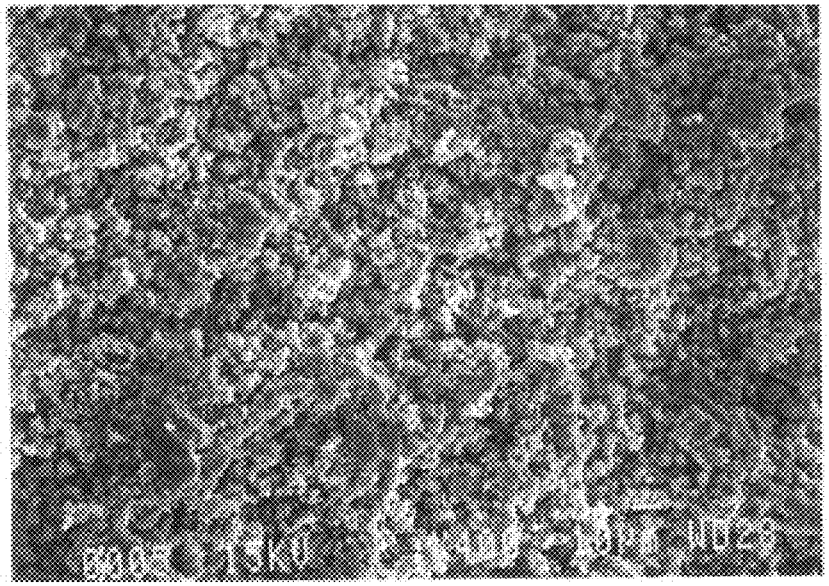
FIG. 1*b* with a magnification of 400.
Figure 1C:
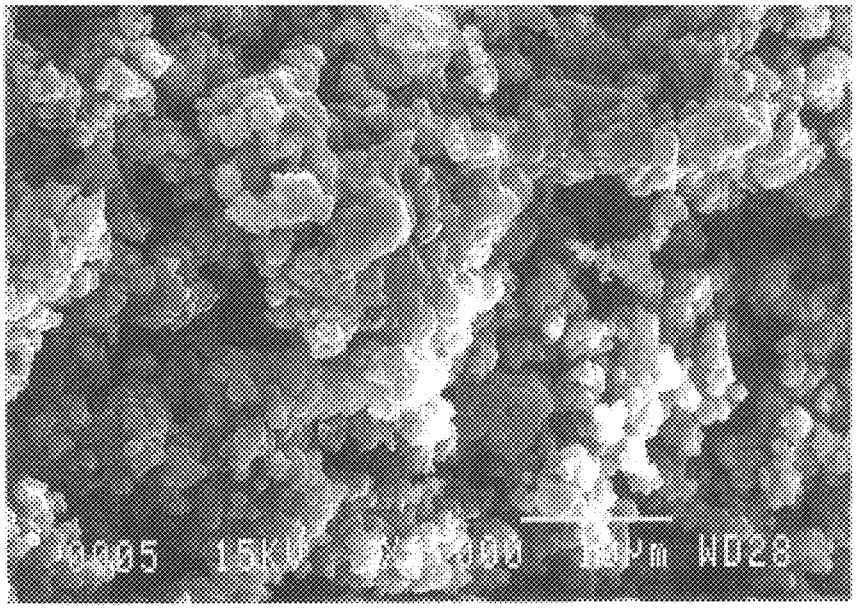
FIG. 1*c* with a magnification of 2000.
Figure 2A:
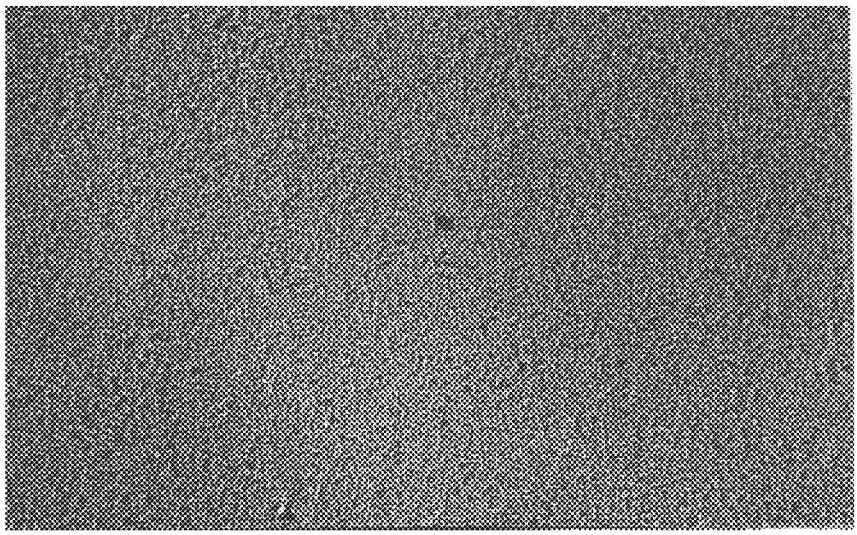
FIG. 2*a* with a magnification of 40.
Figure 2B:
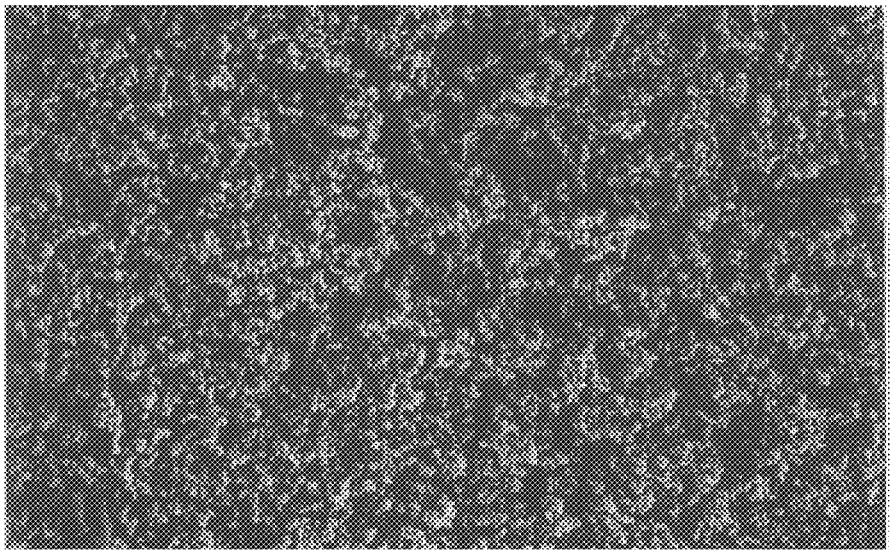
FIG. 2*b* with a magnification of 400.
Figure 2C:
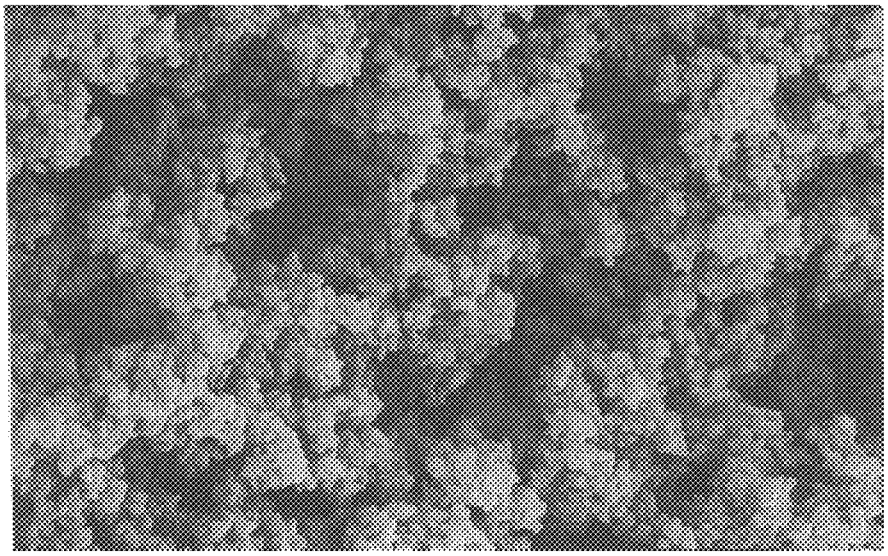
FIG. 2*c* with a magnification of 2000.

The results obtained with regards to appearance are given in FIGS. 1(*a–c*) and 2(*a–c*).

Figure 3:
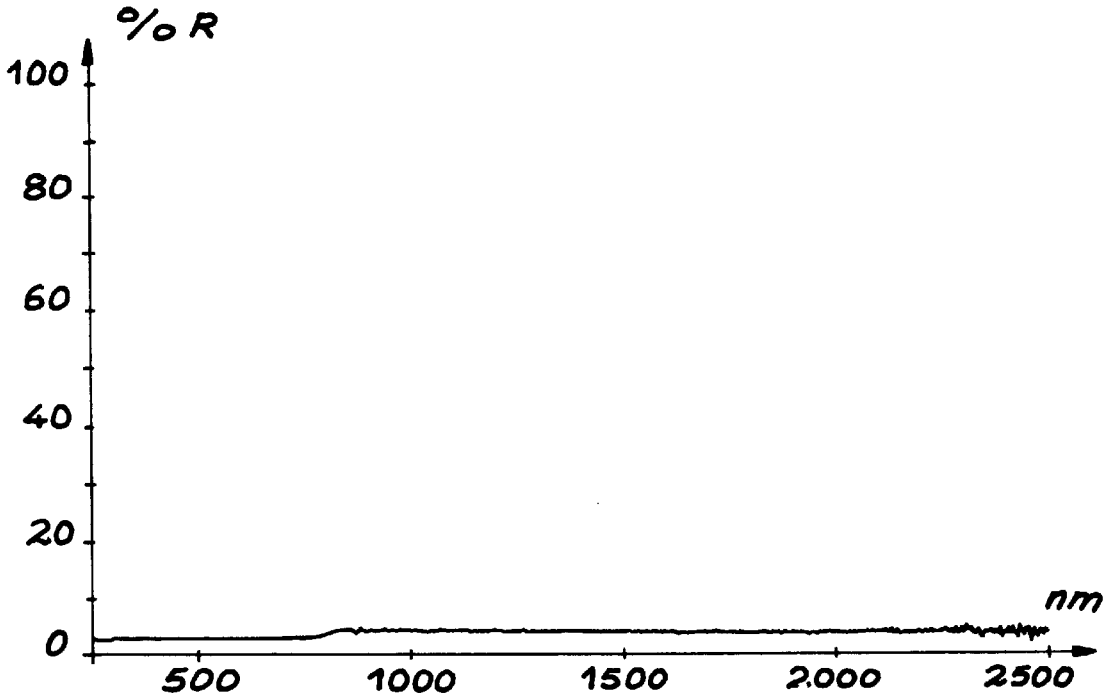
FIGS. 3 and 4 show a curve giving a total reflection coefficient value for wavelengths from 0.25 to 2.5 $\mu$m.
Figure 4:
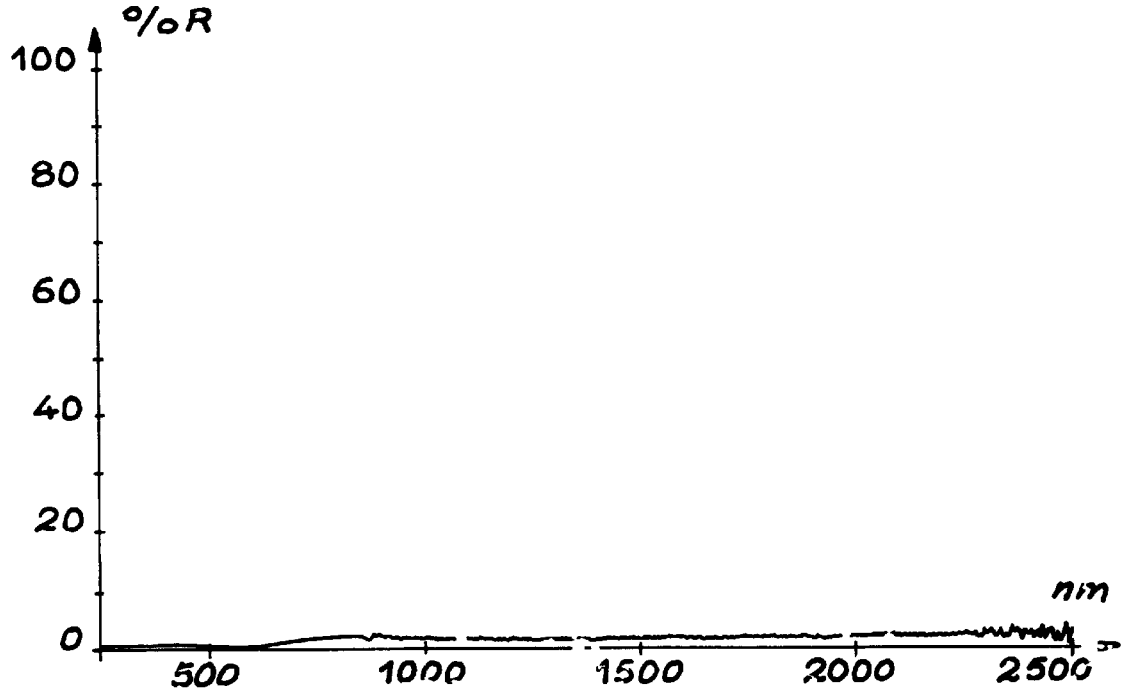

The hemispheric reflection coefficients form the object of on the one hand the curves of FIGS. 3 and 4 and on the other of annexes 1 and 2, which give the values of the reflection coefficients corresponding to curves 3 and 4 respectively. These curves correspond to incident wavelengths between 0.25 and 2.5 $\mu$m.

For wavelengths corresponding to the infrared and far infrared (up to 20 $\mu$m) very low levels were measured, particularly on roughened test-pieces. For example at 10.6 $\mu$m a reflection coefficient of 0.03 for a direction of 25° and 0.06 for a direction of 60° was measured.

What is claimed is:

1. Process for the deposition of a polyaniline coating on a titanium or titanium alloy substrate, characterized in that the process successively comprises:

a fluoronitric etching, a chemical conversion treatment, a hydrolysis and, a polyaniline deposit by electropolymerization.

2. The process for depositing a polyaniline coating on a titanium or titanium alloy subtrate according to claim 1, characterized in that the fluoronitric etching takes place in a bath, comprising:

| | |
|---|---|
| nitric acid 41° C. Be | $HNO_3$:100 to 180 ml |
| hydrofluoric acid (48%) | HF:40 to 60 ml |
| TA6V (metal) | 1.5 g |

for a duration between 2 and 2.5 minutes and an operating temperature between 18 and 22 ° C.

3. The process for depositing a polyaniline coating on a titanium or titanium alloy substrate according to claim 1, characterized in that the process further comprises a preliminary cleaning step.

4. The process for depositing a polyaniline coating on a titanium or titanium alloy subtrate according to claim 3, characterized in that the preliminary cleaning step is an alkaline cleaning.

5. The process for depositing a polyaniline coating on a titanium or titanium alloy subtrate according to claim 4, characterized in that the cleaning composition comprises:

| | |
|---|---|
| sodium tripolyphosphate | $Na_5P_3O_{10}$:36 to 45 g/l |
| sodium tetraborate | $Na_2B_4O_7.10H_2O$:40 g/l |
| soda | NaOH:pH 8.5 to 9.5 |

for a duration between 10 and 15 minutes and an operating temperature between 55 and 65° C.

6. The process for depositing a polyaniline coating on a titanium or titanium alloy substrate according to claim 1, characterized in that the process further comprises a terminal stoving step at a temperature between 40 and 160° C. for between 30 minutes and 2 hours.

7. The process for depositing a polyaniline coating on a titanium or titanium alloy substrate according to claim 1, characterized in that the process further comprises a surface roughing step prior to the fluoronitric etching step.

8. The process for depositing a polyaniline coating on a titanium or titanium alloy subtrate according to claim 7, characterized in that the roughness at the end of the roughening step is between 10 and 30 $\mu$m.

9. The process for depositing a polyaniline coating on a titanium or titanium alloy subtrate according to claim 7, characterized in that the roughness is obtained by sandblasting by means of an abrasive powder under conditions making it possible to obtain a roughness Ra of 10 to 30 $\mu$m.

* * * * *